United States Patent [19]

Fierro

[11] 4,026,174

[45] May 31, 1977

[54] GUARD FOR CIRCULAR SAW

[76] Inventor: Justo Vidaller Fierro, Calle Felipe de Paz, 8, Barcelona, Spain

[22] Filed: Dec. 8, 1975

[21] Appl. No.: 638,671

[30] Foreign Application Priority Data

Dec. 18, 1974 Spain ..... 208471

[52] U.S. Cl. ..... 83/438; 83/478; 83/DIG. 1

[51] Int. Cl.[2] ..... B27G 19/02

[58] Field of Search ..... 83/438, 478, DIG. 1, 83/544, 397

[56] References Cited

UNITED STATES PATENTS

| | | | |
|---|---|---|---|
| 1,526,128 | 2/1925 | Flohr | 83/478 X |
| 1,594,772 | 8/1926 | Fournier | 83/478 X |
| 2,572,326 | 10/1951 | Evans | 83/478 X |
| 2,926,709 | 3/1960 | Kaley | 83/478 |
| 3,105,530 | 10/1963 | Peterson | 83/478 |
| 3,249,134 | 5/1966 | Vogl et al. | 83/478 |
| 3,315,716 | 4/1967 | Mytinger | 83/478 X |
| 3,880,032 | 4/1975 | Green | 83/478 X |

*Primary Examiner*—Frank T. Yost

*Attorney, Agent, or Firm*—Steinberg & Blake

[57] ABSTRACT

A guard for a circular saw having a pair of cranked supports pivotally mounted to the work table at either side of the saw blade, an arm pivotally mounted to the supports extending in line with the saw blade and above it, and a guard member pivotally mounted to the arm having parallel limbs spaced apart and disposed at respective sides of the upper periphery of the saw blade to guard it. There is a plate which joins these arms and which extends transversely of the saw blade to prevent articles cut out from the work piece from being violently ejected from the vicinity of the saw blade. The supports also pivotally carry a plate which is in line with the saw blade and movable between an operative position in which an edge of the plate lies closely adjacent the rear edge of the saw blade, and an inoperative position in which the blade is raised above the table. A further guard member for the front edge of the saw blade extends down from the arm in front of the blade. This guard member is a rotatable wheel displaceable relative to the arms. Workpieces to be cut are fed under the wheel to the saw blade. An adjustable fence for guiding the cutting of workpieces is also provided.

14 Claims, 9 Drawing Figures

FIG. 1
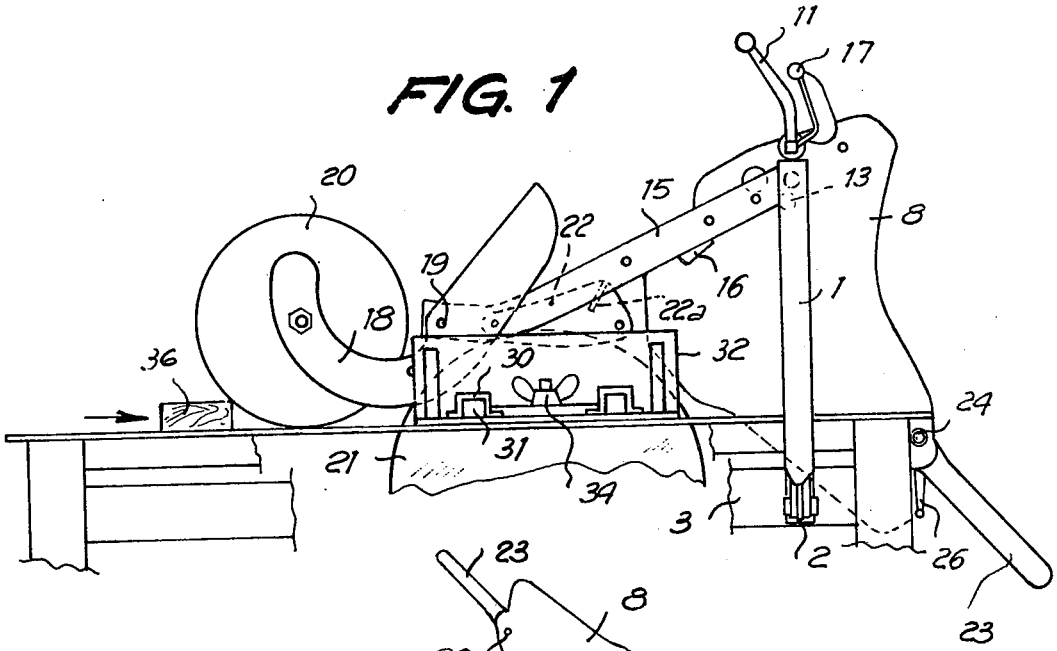
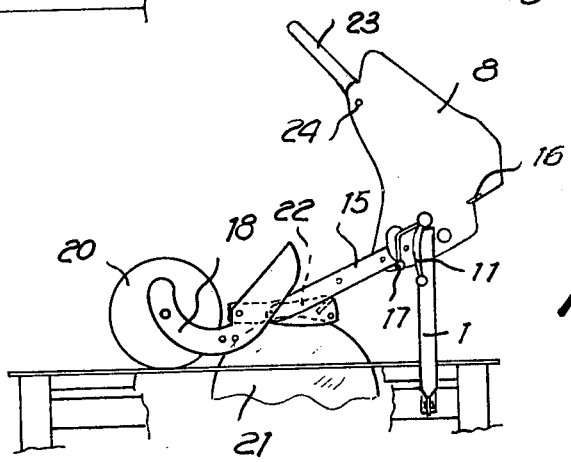
FIG. 2
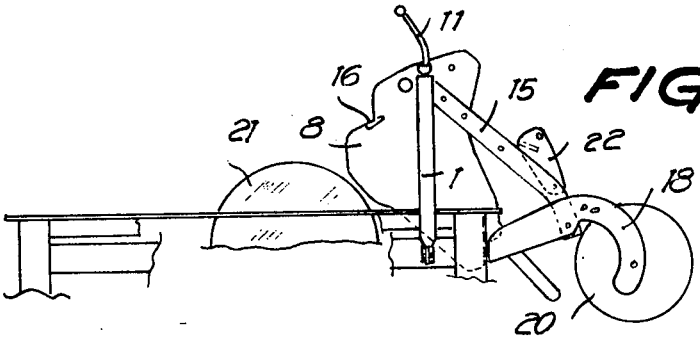
FIG. 3

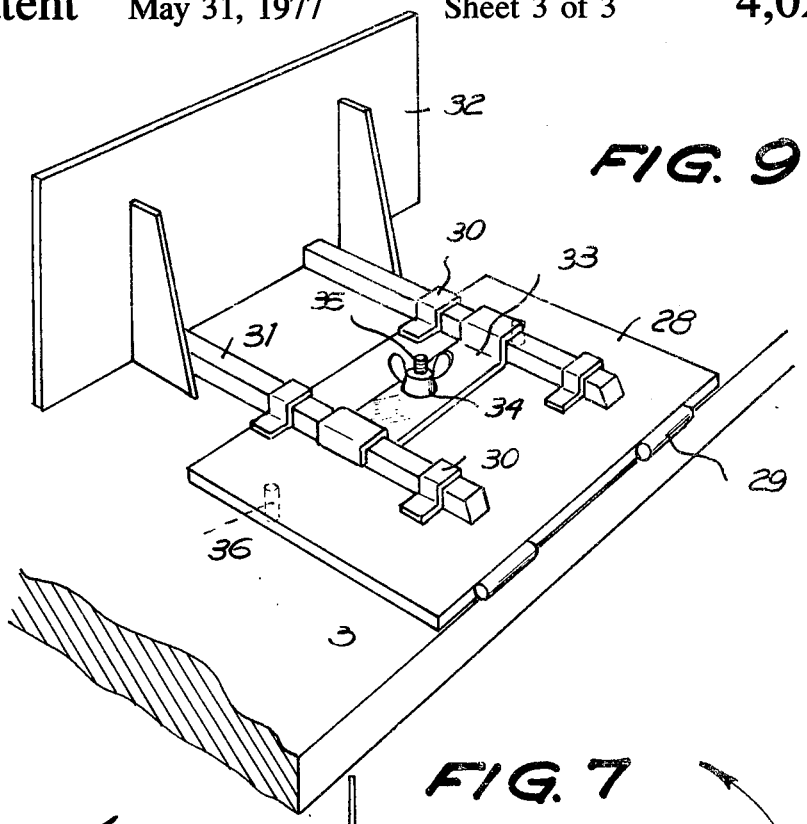
FIG. 9
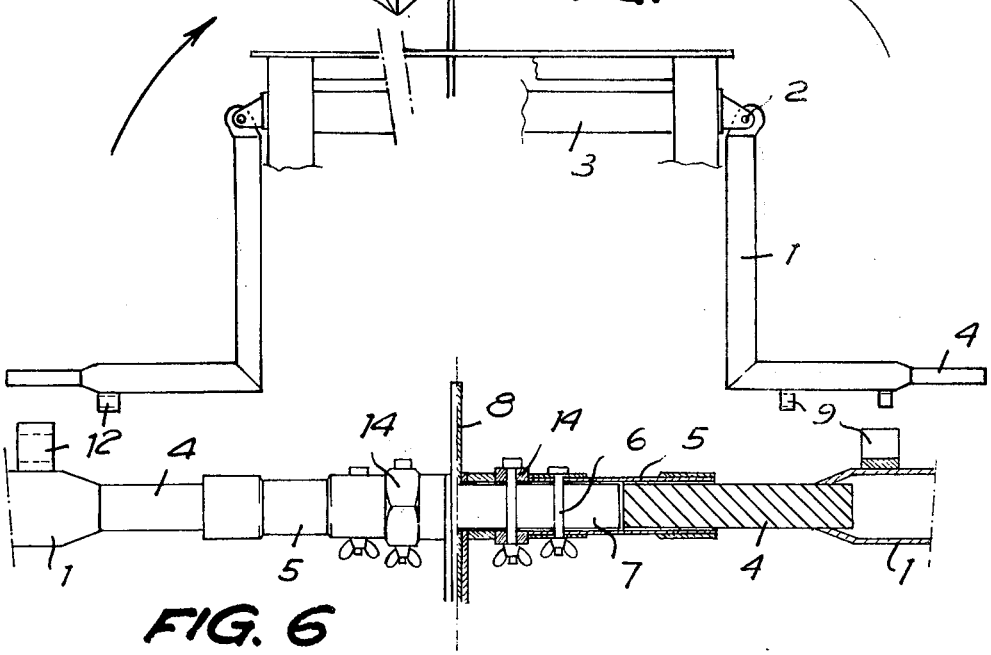
FIG. 7
FIG. 6

GUARD FOR CIRCULAR SAW

BACKGROUND OF THE INVENTION

1. Field of the Invention

The present invention relates to guards for the blades of circular saws, designed to prevent accident to the operator of the machine, and to circular saws having such guards.

More particularly this invention relates to a guard having support means, an arm extending from said support means, at least one position retaining means for said arm, a front guard member, and means on said arm connecting said front guard member to said arm such that said front guard member is displaceable relative to said arm to permit passage of workpieces to be cut said guard being constructed and adapted to be mounted with the arm located by the position retaining means above the blade, and with the front guard member protecting the front edge of the blade, against which workpieces to be sawn are fed.

2. Objects of the Invention

An object of the invention is to provide a guard which has an additional guard member for the upper edge of the blade.

Another object of the invention is to provide a guard which will also indicate when a blade has become excessively worn.

SUMMARY OF THE INVENTION

The improved guard of this invention further comprises an upper edge guard member carried by the arm, said upper edge guard member comprising two limbs in spaced relation, to lie at respective sides of, and thereby guard said upper edge of the blade.

Preferably the limbs of the upper edge guard member are identical planar members parallel to each other. Preferably they are joined by a transverse member in the form of a plate which constrains them into spaced parallel relation and which is positioned to prevent particles torn off from a workpiece during sawing from being violently ejected from the saw blade.

Preferably also the guard further comprises a rear guard plate in line with the blade pivotally mounted to be rotatable between a normal position, in which a front edge of the plate lies adjacent a rear edge of the blade, and an inoperative position in which the plate is raised above the table.

The arm may be pivotally mounted.

The front guard member may comprise a bifurcated member pivotally mounted to the arm, and a plurality of shoes or a wheel pivotally mounted to the bifurcated member.

The plate may include a projecting abutment on which the arm bears when the plate is in the normal position.

The support means may carry a pin having an actuating lever and adapted to extend through a hole formed in the plate so as to retain it in the raised inoperative position, and there may be a further pin articulated to the work table to extend through a respective hole in the plate to retain it in the normal position.

The said pin may carry a support on which the arm bears in its raised inoperative position.

The support means may comprise two symmetrical supports articulated to the work table at either side of the blade and adapted to be lowered below the working surface of the table. They may terminate in shafts and the plate may have further shafts projecting from it on a common axis, the shafts on the supports and those on the plate being rotatably connected by sleeves coaxial therewith.

The said sleeves may be fast with the shafts projecting from the plate. The arm may be pivotally mounted to be pivotable about said common axis of said shafts and sleeves and may be a double arm with one end connected to caps or bushings mounted for rotation on the shafts projecting from the plate.

BRIEF DESCRIPTION OF THE DRAWINGS

FIG. 1 is a side elevation of the device in its normal working position;

FIG. 2 is a similar view, with the rear guard plate raised to its inoperative position;

FIG. 3 is a similar view of FIG. 1 with the double arm in an inoperative position;

FIG. 4 is a detail, in longitudinal section of the upper edge guard member;

FIG. 6 is a half sectioned detail of the pivots for the rear guard plate and arm;

FIG. 7 is a front elevational view showing the supports in their lowered position;

DESCRIPTION OF PREFERRED EMBODIMENT

Figure 8:
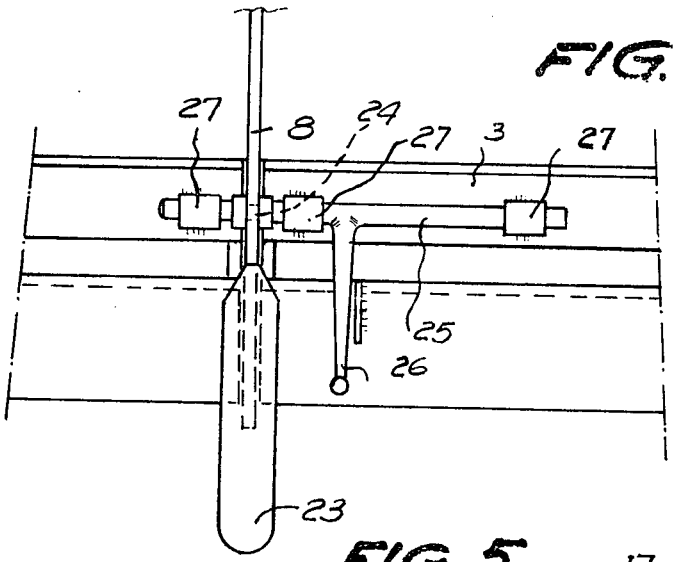
FIG. 8 is a rear elevational view of the pin for securing the rear guard plate in its normal working position.
Figure 5:
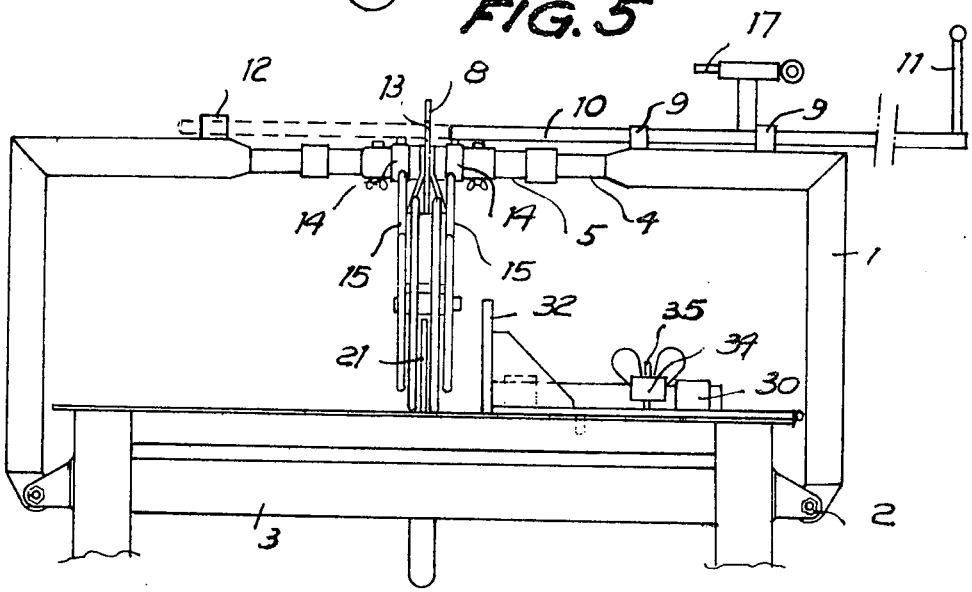
FIG. 5 is a front elevation of the device in its normal working position.

A circular saw has a work table 3, with an upper working surface. A circular blade 21 has an exposed arcuate portion which projects through the table 3. It has a front cutting edge against which workpieces to be sawed are fed, e.g. the piece 36 seen in FIG. 1.

The guard for the saw blade 21 has two cranked supports 1 articulated at their lower ends to lugs 2 fast with the sides of the worktable 3. The supports 1 terminate at their upper ends in associated aligned shafts 4 freely fitting within co-axial sleeves 5 secured by means of pins 6 to further shafts 7 fast with a plate 8 which is in line with the blade 21. The shafts 4, the shafts 7 and the sleeves 5 all lie on a common axis.

One of the supports 1 has, on its upper section, two aligned rings 9 in which are disposed retractable locking means, i.e. a sliding pin 10 provided with an actuating lever 11, while the other of the supports 1 has a ring 12 aligned with the rings 9 to receive the end portion of the pin 10. The plate 8 is formed with an aperture 13 adapted to be aligned with the rings and through which the pin 10 is able to pass.

Pivotally mounted on the shaft 7 are rotatable caps or bushings 14 connected to each of which is one end of an arm member forming half of a double arm 15 adapted to bear on an abutment 16. This projects at either side of and is fast with the plate 8. The abutment 16 constitutes positioning means, maintaining the arm 15 above the blade 21. A stop 17 projects above the pin 10.

A front guard member is constituted by a bifurcated member 18 pivotally mounted at 19 to the other ends of the halves of the double arm 15 remote from the bushings 14 and by a double-disc wheel 20 at one end of the member 18. The other end of the member 18 is prolonged into an arcuate tail.

Pivotally mounted to the halves of the double arm 15, and fitting between them, is an upper edge guard member 22 constituted by two parallel limbs, i.e. planar side plates, connected together by a small plate 22*a*. The side plates lie at either side of the upper periphery of the saw blade 21 with the small plate 22*a* extending transversely across the cutting edge. The member 22 is maintained in position by the abutment 22*b* (FIG. 4) acting as stop means.

The plate 8 is prolonged into a hand grip 23. Near the hand grip there is a hole 24 which can be engaged by further retractable locking means, a pin 25 provided with an actuating lever 26 and guided in rings 27 secured below the working surface of the work table 3.

In the normal operative position (FIG. 1), the circular saw blade 21 is guarded by the bifurcated member 18 including its arcuate tail, by the member 22 and also by the double arm 15. Furthermore, the front edge of the plate 8 follows the rear cutting edge of the circular saw blade. The two arm members constituting the double arm 15 lie at either side of the saw blade 21 and guard part of the upper portion of the cutting edge, while the member 22 disposed between the two arm members of the double arm 15 guards the remainder of the upper portion of the edge of the blade and the small plate 22*a* prevents violent ejection of particles torn off by the "disc".

When it is desired to cut a piece of plastics material, timber 36 or any other workpiece, the workpiece is first pushed up to the wheel 20 as has been done with the piece of timber shown in FIG. 1. If the workpiece to be cut is not supported by the operator in the correct manner, his hands will contact the wheel 20, thereby informing him of the incorrect position of his hands so that he will be able to rectify his error in time.

The teeth of the blade 21 have, when they are sharp, an outward pitch. The thickness of the plate 8 is somewhat less than the width of the saw cut made by the teeth, so that the cut workpiece passes freely, the cut in it being sufficient to receive the plate 8. When the cutting teeth have become worn the cut is narrower and the workpiece is then unable to pass, being impeded by the plate 8 which is too thick for the cut effected. In this manner, the operator is able to work confident that the disc is in the proper condition since if it is worn he will be warned by the above-described fouling of the plate 8 by the workpiece.

When, through the properties of the workpiece to be cut, for example because of its thickness, the plate 8 causes obstruction, the plate can be raised by means of the hand grip 23, rotating it about the axis of the shafts 7 and 4 until it is in the position shown in FIG. 2. In order to secure it in this position, the pin 10 is pushed across to extend through the aperture 13 in the plate and into the ring 12. In this manner, the plate is retained in position.

Although the double arm 15 bears, in the normal working position shown in FIG. 1, on the abutment 16 projecting from the plate 8 preventing it from dropping right down, on displacing the plate 8 it would be without support. In order to prevent this, besides its axial displacement the pin 10 is caused to rotate by actuating the lever 11 until the stop 17 is disposed below the double arm 15 which then bears thereon. Thus the stop 17 also constitutes positioning means for the arm 15. The pin is mounted on a support, affording a possibility for axial displacement and resiliently urged by a spring maintaining it in the working position (not shown).

If the guard is a source of inconvenience or hindrance, it is possible to move it clear by rotating the double arm 15 about the common axis of the shafts 7 and 4 and displacing it rearwardly (FIG. 3) in such manner that the table is unencumbered.

When the width of the workpiece to be cut is such that the arms 1 would give rise to impediment, they may be lowered to the sides of the table, as indicated in FIG. 7, so that the entire assembly is demounted.

Figure 9:
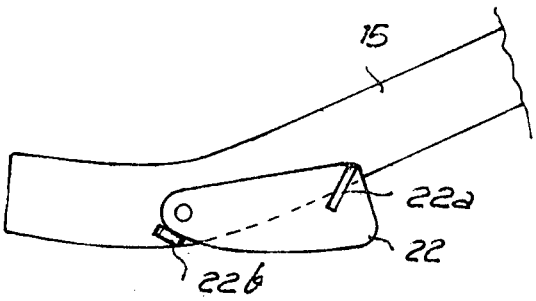
FIG. 9 is a perspective view of the fence.

A plate 28 is articulated to the edge of the working surface of the table 3 by a hinge 29. Secured to the plate 28 are two pairs of stepped brackets 30 in which are guided two bars 31 constituting slide means, fast with a fence 32. Clamping means, a double clamp 33, fits over the bars 31 in the manner of a yoke. It can be tightened to clamp the bars by a wing nut 34 screwed onto a pin 35 projecting from the plate 28 (FIG. 9). From the lower face of the plate 28 extend projections in the form of two studs 36 which fit into corresponding holes formed in the working surface of the work table so as to stabilize the plate 28 against lateral displacement.

The fence 32 serves as an abutment for the workpiece to be cut and its position may be altered displacing the bars 31 through the brackets 30 but it is given stability by the clamp 33. If the board to be cut has large dimensions, the plate 28 may be rotated about the hinge 29 until it is located below the externally of the working surface of the table. The plate 32 is held firm on the table by means of the studs 36 in the corresponding holes formed in the table's working surface.

What is claimed is:

1. In a guard for the blade of a circular saw, the blade having an exposed arcuate portion, said portion having a front edge against which workpieces to be sawed are fed an opposite rear edge and an upper edge, the upper edge extending between and being higher than said front and rear edges, the guard comprising support means, an arm extending from said support means, at least one position retaining means for said arm, a front guard member, and means on said arm connecting said front guard member to said arm such that said front guard member is displaceable relative to said arm, to permit passage of workpieces to be cut, said guard being constructed and adapted to be mounted with the arm located by the position retaining means above the blade, and with the front guard member protecting the front edge of the blade, the improvement comprising an upper edge guard member carried by the arm, said upper edge guard member comprising two limbs in spaced relation, to lie at respective sides of, and thereby guard said upper edge of the blade, said arm being a double arm, comprising two arm members and means constraining said members in spaced relation, and wherein the guard further comprises means mounting said upper edge guard member to said arm, between said two arm members thereof.

2. A guard according to claim 1 wherein said limbs are planar and are parallel to each other and wherein said upper edge guard member further comprises a transverse member, said transverse member extending transversely between said two limbs of said upper edge guard member and being fast with them, whereby said transverse member constrains said limbs into their said spaced relation, and whereby said transverse member is disposed above and transversely of said blade.

3. A guard according to claim 2 wherein said transverse member is a plate, and is positioned to prevent particles torn off from a workpiece during sawing from being violently ejected from the saw blade.

4. A guard according to claim 2 wherein the guard further comprises means pivotally mounting said upper edge guard member to said arm, and stop means limiting pivotal movement of said upper edge guard member thereby maintaining said upper edge guard member with its said transverse member above said blade.

5. A guard according to claim 1 wherein said arm is pivotally mounted, and rests on said position retaining means, thereby being located above said blade.

6. A guard according to claim 1 further comprising a rear guard plate said rear guard plate having a front edge plate being mountable to lie in line with said blade with said front edge of said plate adjacent said rear edge of said blade, thereby to guard said rear edge.

7. In a guard for the blade of a circular saw, the blade having an exposed arcuate portion, said portion having a front edge against which workpieces to be sawed are fed, an opposite rear edge and an upper edge, the upper edge extending between and being higher than said front and rear edges, the guard comprising support means, an arm extending from said support means, at least one position retaining means for said arm, a front guard member, and means on said arm connecting said front guard member to said arm such that said front guard member is displaceable relative to said arm, to permit passage of workpieces to be cut, said guard being constructed and adapted to be mounted with the arm located by the position retaining means above the blade, and with the front guard member protecting the front edge of the blade, the improvement comprising an upper edge guard member carried by the arm, said upper edge guard member comprising two limbs in spaced relation, to lie at respective sides of, and thereby guard said upper edge of the blade, said front guard member comprising a freely rotatable wheel, said wheel being carried by a bifurcated member, said bifurcated member being pivotally mounted to said arm.

8. In a guard for the blade of a circular saw, the blade having an exposed arcuate portion, said portion having a front edge against which workpieces to be sawed are fed, an opposite rear edge and an upper edge, the upper edge extending between and being higher than said front and rear edges, the guard comprising support means, an arm extending from said support means, at least one position retaining means for said arm, a front guard member, and means on said arm connecting said front guard member to said arm such that said front guard member is displaceable relative to said arm, to permit passage of workpieces to be cut, said guard being constructed and adapted to be mounted with the arm located by the position retaining means above the blade, and with the front guard member protecting the front edge of the blade, the improvement comprising an upper edge guard member carried by the arm, said upper edge guard member comprising two limbs in spaced relation, to lie at respective sides of, and thereby guard said upper edge of the blade, a rear guard plate having a front edge and being situated in line with said blade with said front edge of said plate being adjacent said rear edge of said blade, thereby to guard said rear edge, said rear guard plate being pivotally mounted to said support means so as to be rotatable between a normal position and an inoperative position, in said normal position said front edge plate lying adjacent said rear edge of said blade, and in said inoperative position said plate being further from said blade to give access thereto, the guard further comprising respective retractable locking members to retain said plate in the respective positions thereof, said plate defining respective apertures to receive each said locking member.

9. A circular saw comprising a work table, a saw blade and a guard, the work table having a working surface, and said blade having an arcuate exposed portion projecting through said table, said exposed portion having a front edge against which workpieces to be sawed are fed, an opposite rear edge and an upper edge, said upper edge extending between and being higher than said front and rear edges, the guard comprising support means mounted to said work table, an arm extending from said support means above the blade, and a front guard member carried by said arm but displaceable relative thereto, said front guard member protecting said front edge of said blade and an upper edge guard member carried by said arm, said upper edge guard member comprising two limbs in spaced relation and lying at respective sides of, and thereby guarding, said upper edge of said blade, a fence supporting plate pivotally mounted to an edge of said work table at one side of said blade, a fence, and slide means slidingly supporting said fence on said fence supporting plate to be adjustable towards and away from said blade and clamping means operable on said slide means for clamping said fence after adjustment thereof.

10. Circular saw according to claim 9 further compromising projections on said fence supporting plate engageable with corresponding holes in said working surface of said table engagement of said projections with said holes stablising said fence supporting plate on said working surface.

11. A circular saw comprising a work table, a saw blade and a guard, the work table having a working surface, and said blade having an arcuate exposed portion projecting through said table, said exposed portion having a front edge against which workpieces to be sawed are fed, an opposite rear edge and an upper edge, said upper edge extending between and being higher than said front and rear edges, the guard comprising support means mounted to said work table, an arm extending from said support means above the blade, and a front guard member carried by said arm but displaceable relative thereto, said front guard member protecting said front edge of said blade and an upper edge guard member carried by said arm, said upper edge guard member comprising two limbs in space relation and lying at respective sides of, and thereby guarding, said upper edge of said blade, a rear guard plate, said rear guard plate having a front edge, said rear guard plate being disposed in line with said blade wherein said support means comprises a pair of supports pivotally mounted to said work table at respective sides of said blade, said supports terminating in shafts, said rear guard plate having further shafts projecting therefrom at either side thereof said shafts and said further shafts being on a common axis, a said shaft and a said further shaft at each side of said plate having a coaxial sleeve, said sleeves rotatably connecting said shafts and further shafts, and wherein said rear guard plate is rotatable relative to said support means between a normal position and an inoperative position, in said normal portion said front edge of said rear guard plate being disposed adjacent said rear edge of said blade, and in said inoperative position said rear guard plate being raised above said work table thereby giving greater access to said rear edge of said blade.

12. A saw according to claim 11 wherein said blade has peripheral cutting teeth, the cutting teeth, when sharp, having an outward pitch, whereby said teeth effect a cut in a workpiece of predetermined width, said rear guard plate having a thickness less than said predetermined width, whereby said rear guard plate does not impede passage of a workpiece being cut, provided said cutting teeth of said blade are sharp.

13. A circular saw according to claim 11 wherein said arm is a double arm, comprising two arm members and means constraining said arm members in spaced relation, said arm members having ends proximate said rear guard plate and ends remote therefrom, said ends proximate said rear guard plate being pivotally mounted to respective ones of said further shafts projecting from said plate.

14. A circular saw according to claim 11 further comprising respective locking pins engageable in respective holes in said plate to retain said plate respectively in said normal and said inoperative positions, the pin retaining said plate in its inoperative position further comprising a stop, said rear guard plate further comprising a projecting abutment, in said normal position of said plate, said arm bearing on said abutment and being supported thereby above said saw blade, and in said inoperative position of said plate, said arm bearing on said stop and being supported thereby over said blade.

* * * * *